US009707782B2

(12) United States Patent
Yamagishi

(10) Patent No.: US 9,707,782 B2
(45) Date of Patent: Jul. 18, 2017

(54) LIQUID EJECTING APPARATUS

(71) Applicant: Seiko Epson Corporation, Tokyo (JP)

(72) Inventor: Ken Yamagishi, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/251,354

(22) Filed: Aug. 30, 2016

(65) Prior Publication Data

US 2017/0072720 A1 Mar. 16, 2017

(30) Foreign Application Priority Data

Sep. 11, 2015 (JP) ..... 2015-180018

(51) Int. Cl.

| | |
|---|---|
| ***B41J 2/165*** | (2006.01) |
| ***B41J 25/00*** | (2006.01) |
| ***B41J 2/01*** | (2006.01) |
| *B41J 2/15* | (2006.01) |

(52) U.S. Cl.

CPC ..... *B41J 25/006* (2013.01); *B41J 2/01* (2013.01); *B41J 2/15* (2013.01)

(58) Field of Classification Search

CPC ..... B41J 2/01; B41J 2/15; B41J 1/24; B41J 25/006; B41J 2/165; B41J 2/16505; B41J 2/16511; B41J 2/16547; B41J 2/16588

See application file for complete search history.

(56) References Cited

U.S. PATENT DOCUMENTS

2006/0125874 A1* 6/2006 Lee ..... B41J 23/025 347/33

2009/0066747 A1 3/2009 Hays et al.

FOREIGN PATENT DOCUMENTS

| | | | |
|---|---|---|---|
| JP | 07-329297 | A | 12/1995 |
| JP | 2007-111932 | A | 5/2007 |
| JP | 2009-061779 | A | 3/2009 |

* cited by examiner

*Primary Examiner* — Thinh H Nguyen

(74) *Attorney, Agent, or Firm* — Harness, Dickey & Pierce, P.L.C.

(57) ABSTRACT

Provided is a liquid ejecting apparatus including: a head configured to reciprocate and having a nozzle surface provided with a nozzle for discharging a liquid; a lock configured to regulate reciprocation of the head; and a liquid saucer configured to receive the liquid, in which the nozzle surface of the head faces the liquid saucer and is separated from the liquid saucer in a state where reciprocation is regulated by the lock.

20 Claims, 11 Drawing Sheets

LIQUID EJECTING APPARATUS

CROSS REFERENCE TO RELATED APPLICATION(S)

This application claims priority to Japanese Patent Application No. 2015-180018 filed on Sep. 11, 2015. The entire disclosures of Japanese Patent Application No. 2015-180018 is hereby incorporated herein by reference.

BACKGROUND

1. Technical Field

The present invention relates to a liquid ejecting apparatus provided with a liquid ejecting head that ejects a liquid from a nozzle opening, and particularly to an ink jet recording apparatus which is provided with an ink jet recording head that discharges an ink as a liquid.

2. Related Art

As a liquid ejecting apparatus which ejects a liquid on a medium to be ejected, for example, an ink jet recording apparatus has been known which performs printing on a medium, to be recorded, such as paper or a recording sheet, that is, a medium to be ejected, by ejecting an ink as a liquid.

There is an ink jet recording head which is mounted on such an ink jet recording apparatus and on which a cap for protecting the discharge surface of the recording head is mounted, in a case of not being used over a long period of time, or the like. However, there is a case where no cap is mounted thereon or a case where it is necessary to leave the recording head as it is in a state in which a cap is open even if the cap is mounted thereon. Examples of the case include a case of avoiding a problem in which cracking is caused in the pressure generating chamber, in particular, on a vibrating plate, in a case where an ink in a pressure generating chamber freezes and is expanded, and if there is no space for the ink to escape in the pressure generating chamber; and a case where a nozzle plate is peeled off due to stress received from the cap, if the recording head is left as it is for a long period of time while the recording head is covered with the cap.

In such a situation, there is a problem in that the inside of an apparatus is contaminated by an ink dripping from the recording head, particularly in a case of moving the apparatus or the like.

In recent years, an apparatus in which a problem, in which ink droplets ejected through an evacuation operation float after becoming mist due to air resistance before landing on an evacuation box and contaminate surroundings, has been solved has been proposed (for example, refer to JP-A-2007-111932).

However, in the above-described apparatus, there is no particular disclosure of countermeasures for the dripping of an ink when not in use.

Similarly, such problems also exist in a liquid ejecting apparatus which ejects a liquid other than an ink as well as in the ink jet recording apparatus.

SUMMARY

An advantage of some aspects of the invention is to provide a liquid ejecting apparatus which can prevent contamination due to dripping of a liquid from a recording head when not in use.

According to an aspect of the invention, there is provided a liquid ejecting apparatus including: a head which reciprocates and has a nozzle surface provided with a nozzle discharging a liquid; a lock (that is a lock mechanism) which regulates reciprocation of the head; and a liquid saucer which receives the liquid, in which the nozzle surface of the head faces the liquid saucer and is separated from the liquid saucer in a state where reciprocation is regulated by the lock mechanism.

In the aspect, it is possible to regulate reciprocation of the head (carriage) in a state where the nozzle surface of the head and the liquid saucer are made to face each other, and therefore, it is possible to reduce contamination of a main body of the apparatus caused by a dripping liquid. In addition, the reciprocation of the head (carriage) is regulated in a state where the nozzle surface of the head and the liquid saucer are separated from each other. Therefore, it is possible to reduce harmful influence caused by the nozzle surface of the head and the liquid saucer being brought into contact with each other and being left over a long period of time. In addition, it is possible to regulate the reciprocation of the head (carriage), and therefore, it is possible to prevent unexpected movement of the head during transportation or the like.

It is preferable that the lock mechanism regulates reciprocation of the head at a first position and a second position, the head faces the liquid saucer and is separated from the liquid saucer in a state where reciprocation is regulated at the first position by the lock mechanism, and the head faces a cap and comes into contact with the liquid saucer in a state where reciprocation is regulated at the second position by the lock mechanism. In the aspect, it is possible to prevent the movement of the head at the second position in a state where drying of the nozzle is prevented.

In addition, it is preferable that the liquid saucer has a discharge port which is connected to a discharge path on a surface facing the nozzle surface, the cap has a rib and an atmosphere release path, the rib forms a closed space between the nozzle surface and the rib by being closely adhered to the nozzle surface, and the atmosphere release path allows communication between the closed space and the atmosphere. In the aspect, the apparatus has a liquid saucer separately from the cap which prevents thickening of the liquid in the nozzle. Therefore, it is possible to prevent the dripping liquid from blocking the atmosphere release path of the liquid saucer.

In addition, it is preferable that the liquid saucer is connected to a pump for suctioning the liquid from the nozzle. In the aspect, air bubbles in the head can be discharged from the nozzle by sharing the liquid saucer with a suction cap.

In addition, it is preferable that the cap is lifted through reciprocation of the head, and the liquid saucer is not lifted through the reciprocation of the head. In the aspect, it is possible to switch the contact and the separation between the liquid saucer and the head through the reciprocation of the head, and therefore, it is possible to simplify the structure.

In addition, it is preferable that the liquid saucer receives a liquid discharged from the head during evacuation. In the aspect, it is possible to appropriately discharge the thickened liquid in the nozzle by sharing the liquid saucer with a saucer during the evacuation operation.

In addition, it is preferable that the liquid saucer has a dimension in which the liquid saucer faces a nozzle of a liquid which is most easily dripped and does not face a nozzle of a liquid which is most hardly dripped, among a plurality of liquids. In the aspect, the liquid saucer is miniaturized and space is saved.

In addition, it is preferable that the lock mechanism is either of a concave portion and a convex portion which are engaged with each other, and the head or a carriage has a plurality of the other sides of the concave portions and the convex portions. In the aspect, it is possible to regulate the reciprocation of the head with respect to a plurality of concave portions or convex portions using one lock mechanism, and therefore, it is possible to reduce the number of parts.

In addition, it is preferable that the head in a state where reciprocation is regulated by the lock mechanism at the second position contains air bubbles in a manifold which communicates with the nozzle. In the aspect, it is possible to take a countermeasure against freezing by drawing air bubbles into the manifold.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
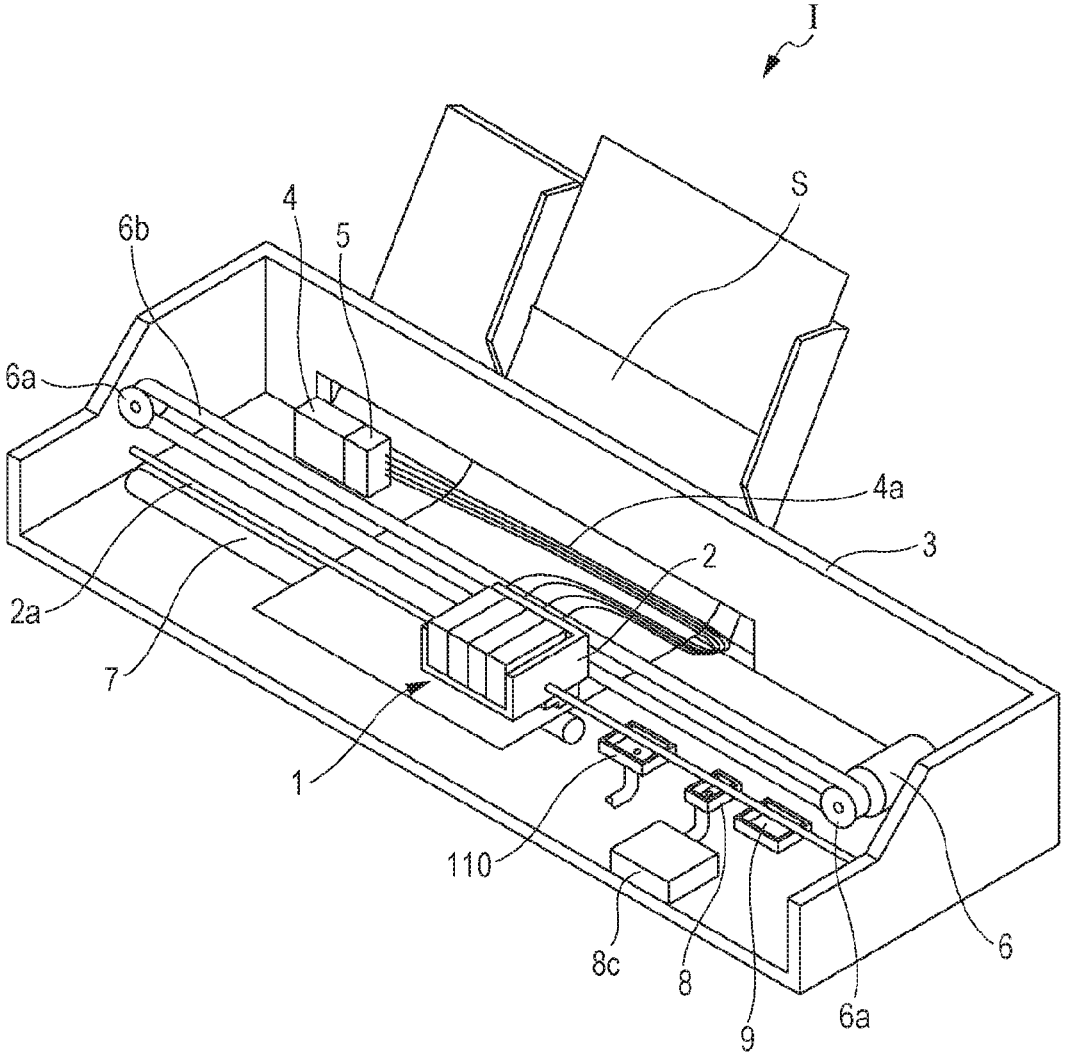
FIG. 1 is a schematic perspective view of a recording apparatus according to Embodiment 1 of the invention.
Figure 2:
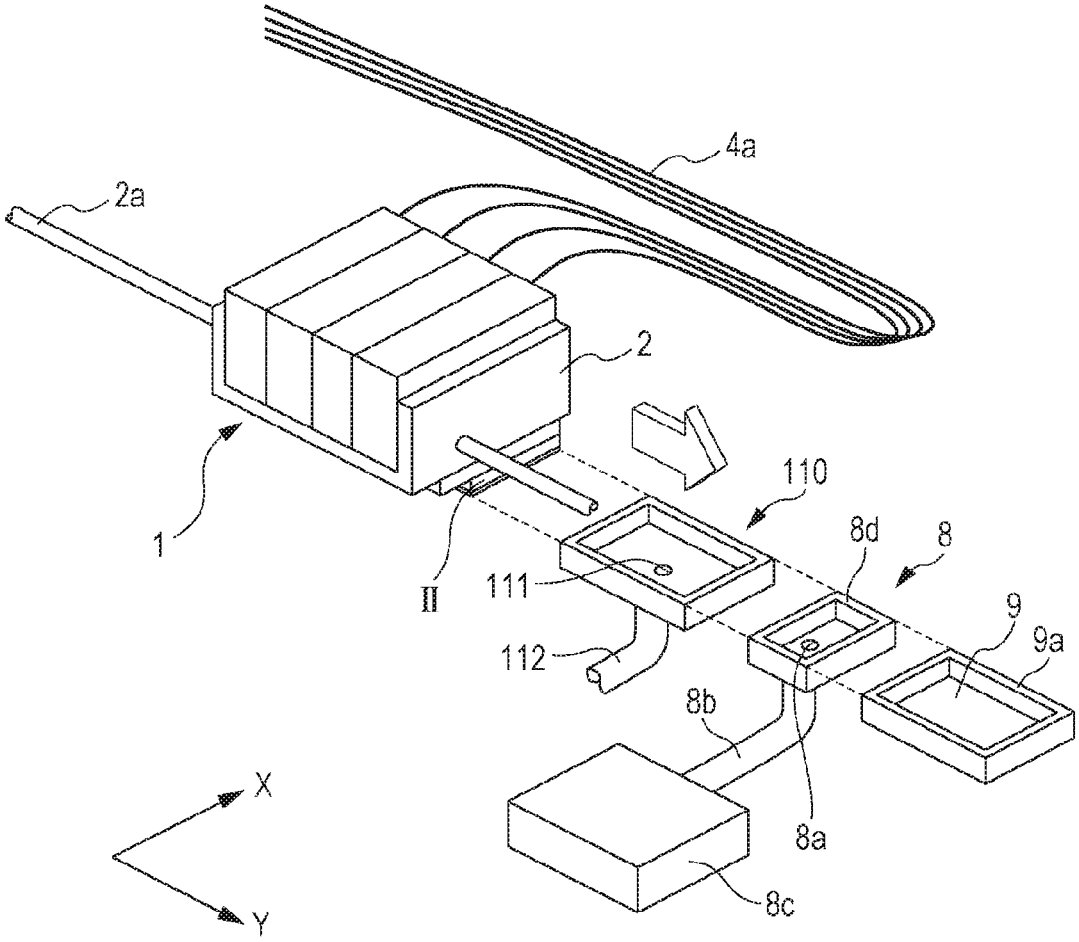
FIG. 2 is a perspective view illustrating a cap according to Embodiment 1 of the invention.

FIG. 1 is a perspective view showing a schematic structure of an ink jet recording apparatus which is an example of a liquid ejecting apparatus according to Embodiment 1 of the invention, and FIG. 2 is a perspective view showing a suction cap and a protection cap which are cap units, and a liquid saucer.

As shown in FIG. 1, in a liquid ejecting apparatus I of the present embodiment, a liquid ejecting head unit 1 is mounted on a carriage 2. The carriage 2 on which the liquid ejecting head unit 1 is mounted is provided so as to be movable in an axial direction with respect to a carriage shaft 2*a* which is attached to a housing 3.

In addition, the housing 3 is provided with a storage unit 4 in which a liquid is stored and the liquid from the storage unit 4 is supplied to the liquid ejecting head unit 1 which is mounted on the carriage 2 through a tube 4*a*. In addition, a blocking unit 5 which is a choke valve that blocks a flow path of each tube 4*a* is provided in the vicinity of the storage unit 4 of the tube 4*a*.

The carriage 2 on which the liquid ejecting head unit 1 is mounted is moved along the carriage shaft 2*a* due to driving force of a driving motor 6 being transmitted to the carriage 2 through a plurality of pulleys 6*a* and a timing belt 6*b*. That is, in the present embodiment, the carriage 2, the driving motor 6, the plurality of pulleys 6*a*, the timing belt 6*b*, and the like constitute a movement mechanism. In contrast, a transport roller 7 as a transport unit is provided in the housing 3, and a recording sheet S which is a recording medium such as paper is transported by the transport roller 7. The transport unit which transports the recording sheet S is not limited to the transport roller and may be a belt, a drum, or the like.

In such a liquid ejecting apparatus I, the carriage 2 moves along the carriage shaft 2*a* and a liquid lands on a recording sheet S by being discharged as liquid droplets by the liquid ejecting head unit 1.

In addition, a suction cap 8 and a protection cap 9 which are cap units, and a liquid saucer 110 are provided in a non-printing region on the side of the transport roller 7 which is an end portion of the carriage 2 in a movement direction.

The suction cap 8 does not cover the entirety of the nozzle surface of the liquid ejecting head unit 1. The suction cap has a size enough to cover nozzle surfaces for each of a plurality of heads included in the liquid ejecting head unit 1 and performs a suction operation for each head. In addition, a discharge port 8*a* is provided on the bottom surface facing the nozzle surfaces of the suction cap 8, and a suction unit 8*c* is connected to the discharge port 8*a* through the discharge path 8*b*. In addition, the suction cap 8 has a rib 8*d* on the nozzle surface side. The rib 8*d* is closely adhered to the nozzle surfaces and forms a closed space between the rib and the inner nozzle surface. The suction unit 8*c* suctions a liquid from a nozzle opening of the nozzle surface by reducing the pressure of the closed space.

The protection cap 9 has a size enough to cover the nozzle surfaces of the plurality of heads of the liquid ejecting head unit 1 and has a rib 9*a* abutting onto the nozzle surfaces. The rib 9*a* is closely adhered to the nozzle surfaces and forms a closed space between the rib and the inner nozzle surface. In addition, the protection cap 9 includes an atmosphere release path (snake path) not shown in the drawing. The protection cap 9 is used for preventing drying of a nozzle opening 21 when not in use (when being left as it is for a long period of time (at Mode 3 to be described below)). However, an adsorption member such as a sponge adsorbing a liquid is merely provided inside the protection cap 9, and there is no mechanism for discharging a liquid.

The liquid saucer 110 has a size enough to cover the nozzle surfaces of the plurality of heads of the liquid ejecting head unit 1, and is provided with a discharge port 111 on the bottom surface facing the nozzle surfaces. A discharge path 112 is connected to the discharge port 111 to which a waste liquid tank or the like not shown in the drawing is connected. The liquid saucer 110 is used as a saucer of a liquid during an evacuation operation, and is used when Mode 1 and Mode 2 to be described below is not in use.

The suction cap 8 may be used as the protection cap without providing the protection cap 9 separately from the suction cap 8 which has the same size as that of the protection cap 9.

In the above-described liquid ejecting apparatus I, an example in which the liquid ejecting head unit 1 is moved in the main scanning direction by being mounted on the carriage 2 has been exemplified, but the invention is not particularly limited thereto. For example, the invention can also be applied to a so-called line type recording apparatus in which printing is performed by fixing the liquid ejecting head unit 1 to the housing 3 and moving the recording sheet S such as paper in the sub-scanning direction. Here, the movement of the head unit in the main scanning direction in a case where the head unit is a serial type head unit, and ascending and descending of a line type head unit in the vertical direction correspond to the reciprocation of the head of the invention.

In addition, in the above-described example, the liquid ejecting apparatus I has a configuration in which the storage unit 4 is mounted in the housing 3, but the invention is not limited thereto. For example, a liquid may be supplied from outside of the liquid ejecting apparatus I without mounting the storage unit 4 in the housing 3.

Figure 3:
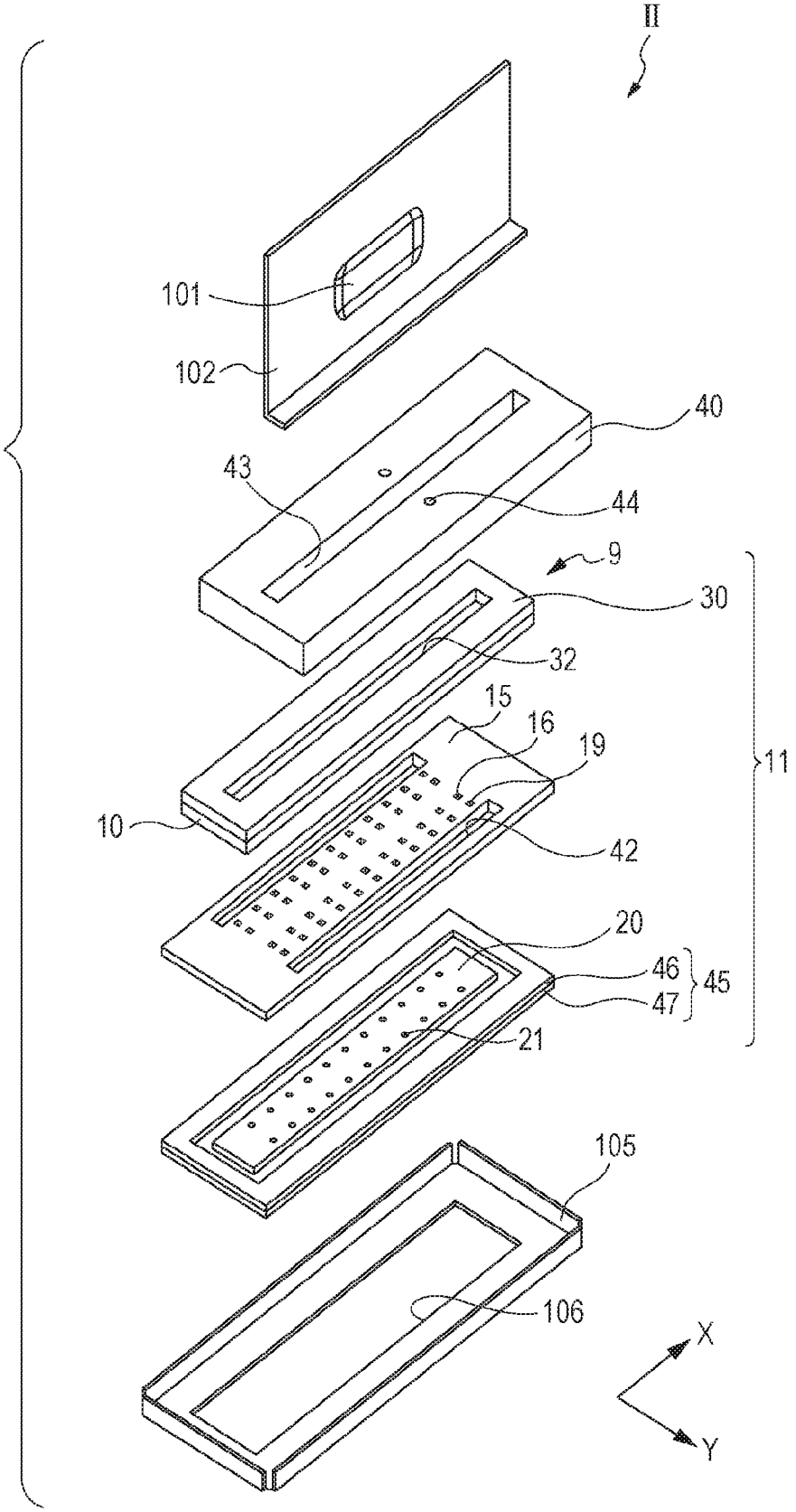
FIG. 3 is an exploded perspective view of a recording head according to Embodiment 1 of the invention.
Figure 4:
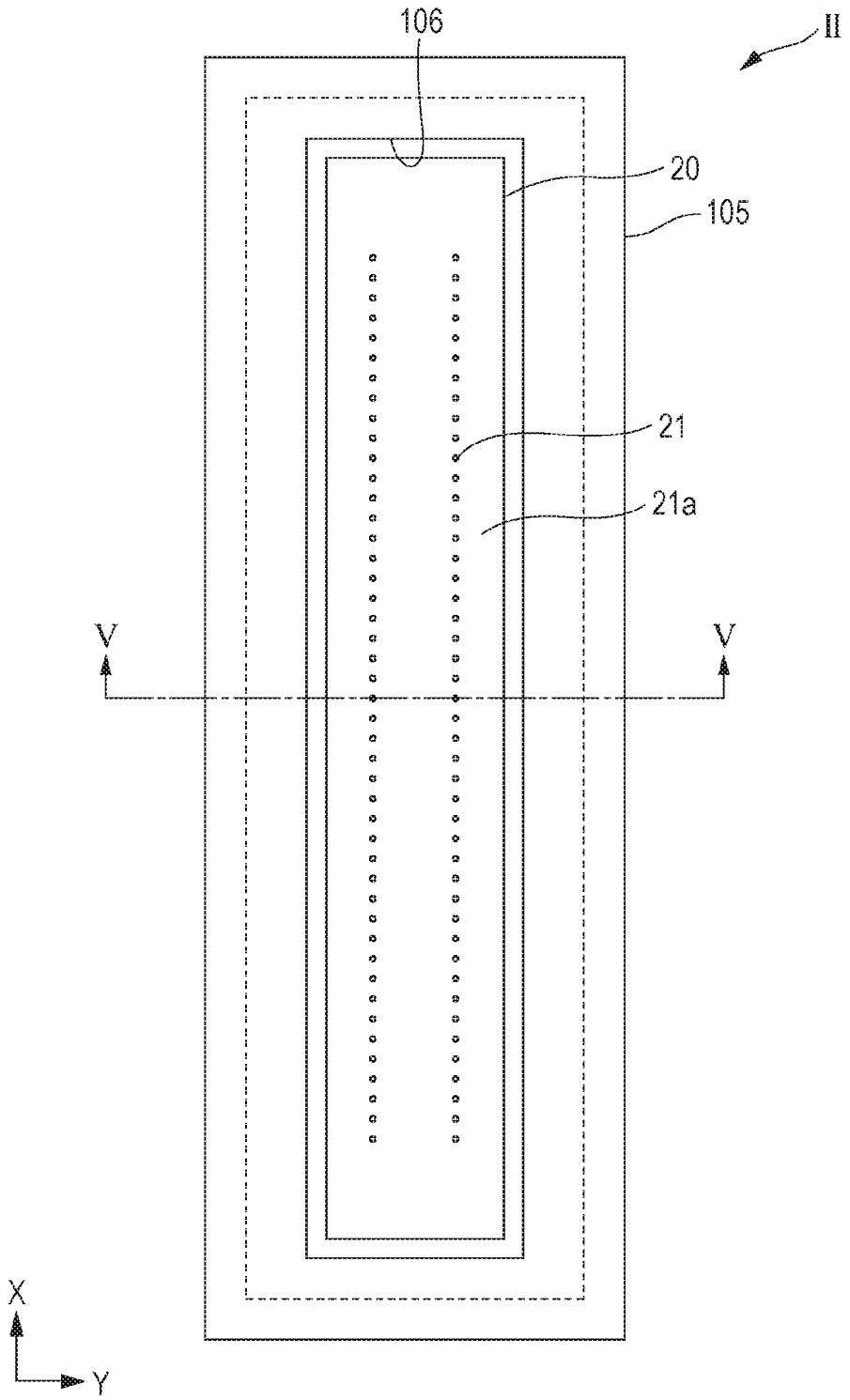
FIG. 4 is a plan view on a liquid ejecting surface side of the recording head according to Embodiment 1 of the invention.
Figure 5:
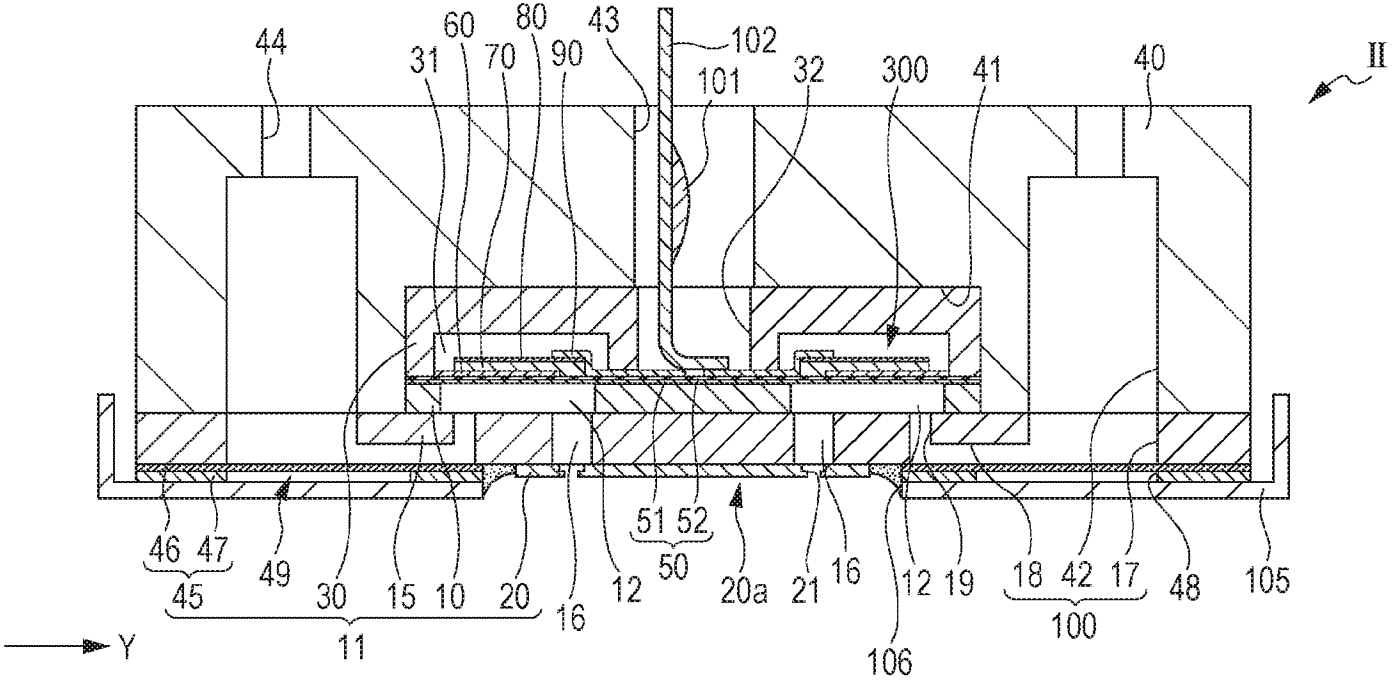
FIG. 5 is a cross-sectional view of the recording head according to Embodiment 1 of the invention.

Here, an example of an ink jet recording head constituting the head unit 1 mounted in such an ink jet recording apparatus will be described with reference to FIGS. 3 to 5. FIG. 3 is an exploded perspective view of an ink jet recording head, FIG. 4 is a plan view on a liquid ejecting surface side of the ink jet recording head, and FIG. 5 is a cross-sectional view taken along line V-V in FIG. 4.

As shown in the drawings, an ink jet recording head II of the present embodiment is provided with a plurality of members such as a head main body 11, a case member 40, and the like, and the plurality of members are bonded to each other using an adhesive. In the present embodiment, the ink jet recording head II is provided with the head main body 11, a flow path forming substrate 10, a communication plate 15, a nozzle plate 20, a protection substrate 30, and a compliance substrate 45.

In the flow path forming substrate 10 constituting the head main body 11, metal such as stainless steel or Ni; ceramic materials represented by $ZrO_2$ or $Al_2O_3$; glass ceramic materials; oxides such as MgO and $LaAlO_3$, and the like can be used. In the present embodiment, the flow path forming substrate 10 is constituted of a silicon single crystal substrate. Pressure generating chambers 12 which are partitioned by a plurality of partition walls by being subjected to anisotropic etching on one surface side are arranged in the flow path forming substrate 10 in parallel along a direction in which a plurality of nozzle openings 21 through which an ink is discharged are arranged in parallel. Hereinafter, this direction is referred to as a juxtaposition direction of a pressure generating chamber 12 or a first direction X. In addition, the flow path forming substrate 10 is provided with a plurality of rows of the pressure generating chambers 12 which are arranged in parallel in the first direction X, and in the present embodiment, two rows of the pressure generating chambers 12. Hereinafter, the row direction in which a plurality of rows of the pressure generating chambers 12 which are formed along the first direction X are arranged in rows is referred to as a second direction Y.

In addition, the flow path forming substrate 10 may be provided with a supply path or the like, of which the opening area is narrower than that of a pressure generating chamber 12 and which imparts flow path resistance to an ink flowing into the pressure generating chamber 12, on one end portion in the second direction Y of the pressure generating chamber 12.

In addition, the communication plate 15 is bonded to one surface side of the flow path forming substrate 10. In addition, the nozzle plate 20, in which a plurality of nozzle openings 21 that communicate with pressure generating chambers 12 are bored, is bonded to the communication plate 15.

Nozzle communication paths 16 which allow communication between the pressure generating chambers 12 and the nozzle openings 21 are provided in the communication plate 15. The communication plate 15 has an area larger than that of the flow path forming substrate 10 and the nozzle plate 20 has an area smaller than that of the flow path forming substrate 10. It is possible to achieve cost reduction by making the area of the nozzle plate 20 comparatively smaller in this manner. In the present embodiment, the surface on which the nozzle openings 21 of the nozzle plate 20 are open and ink droplets are discharged is referred to as a liquid ejecting surface 20*a* (also referred to as a nozzle surface).

In addition, the communication plate 15 is provided with a first manifold portion 17 and a second manifold portion 18 which constitute a part of a manifold 100.

The first manifold portion 17 is provided so as to penetrate the communication plate 15 in a thickness direction (stacking direction of the communication plate 15 and the flow path forming substrate 10).

In addition, the second manifold portion 18 is provided so as to open to the nozzle plate 20 of the communication plate 15 without penetrating the communication plate 15 in the thickness direction.

Furthermore, a supply communication path 19 which communicates with one end portion of the pressure generating chamber 12 in the second direction Y is independently provided on the communication plate 15 for each pressure generating chamber 12. The supply communication path 19 communicates between the second manifold portion 18 and the pressure generating chamber 12.

In such a communication plate 15, it is possible to use metal such as stainless steel or Ni, or ceramics such as zirconium. As the communication plate 15, a material which has a linear expansion coefficient the same as that of the flow path forming substrate 10 is preferable. That is, in a case where a material of which the linear expansion coefficient is greatly different from that of the flow path forming substrate 10 is used as the communication plate 15, warpage occurs due to the difference in the linear expansion coefficient between the flow path forming substrate 10 and the communication plate 15 due to heating or cooling. In the present embodiment, it is possible to suppress generation of warpage due to heat, cracks or peeling due to heat, or the like using the material of which the linear expansion coefficient is the same as that of the flow path forming substrate 10 as the communication plate 15, that is, the silicon single crystal substrate.

In addition, the nozzle openings 21 which communicate with the pressure generating chambers 12 through the nozzle communication path 16 are formed on the nozzle plate 20. That is, the nozzle openings 21 which eject the same kind of liquid (ink) are arranged in parallel in the first direction X, and the rows of the nozzle openings 21 which are arranged in parallel in the first direction X are formed in two rows in the second direction Y.

In such a nozzle plate 20, for example, it is possible to use metal such as stainless steel (SUS), organic substances such as polyimide resin, silicon single crystal substrates, or the like. It is possible to suppress generation of warpage due to heating or cooling, cracks or peeling due to heat, or the like using the silicon single crystal substrate as the nozzle plate 20, thereby making the linear expansion coefficients between the nozzle plate 20 and the communication plate 15 the same as each other.

In contrast, a vibrating plate 50 is formed on a surface side which is opposite to the communication plate 15 of the flow path forming substrate 10. In the present embodiment, an elastic film 51 which is formed of silicon oxide and is provided on the flow path forming substrate 10 and an insulator film 52 which is formed of zirconium oxide and is provided on the elastic film 51 are provided as the vibrating plate 50. The liquid flow path such as the pressure generating chamber 12 is formed by being subjected to anisotropic etching of the flow path forming substrate 10 from one surface side, that is, the surface side to which the nozzle plate 20 is bonded. The other surface of the liquid flow path such as the pressure generating chamber 12 is demarcated by the elastic film 51.

In addition, in the present embodiment, a first electrode 60, a piezoelectric layer 70, and a second electrode 80 are stacked and formed on the insulator film 52 of the vibrating plate 50 through a film forming method and a lithography method to constitute a piezoelectric actuator 300. Here, the piezoelectric actuator 300 is also called piezoelectric element 300 and indicates a portion which includes the first electrode 60, the piezoelectric layer 70, and the second electrode 80. In general, any one electrode of the piezoelectric actuator 300 is set to a common electrode, and the other electrode and the piezoelectric layer 70 are formed by being patterned for each pressure generating chamber 12. Here, the portion, which is formed of any one electrode and the piezoelectric layer 70 that are patterned and in which a piezoelectric strain is caused through application of a voltage to both the electrodes, is called a piezoelectric body active portion. In the present embodiment, the first electrode 60 is set to the common electrode of the piezoelectric actuator 300 and the second electrode 80 is set to a separate electrode of the piezoelectric actuator 300. However, there is no problem even if this setting is reversed due to circumstances related to driving circuits or wirings. In the above-described example, the first electrode 60 is continuously provided over a plurality of pressure generating chamber 12, and therefore, the first electrode 60 functions as a part of the vibrating plate. However, as a matter of course, the invention is not limited thereto, and for example, the first electrode 60 may act alone as the vibrating plate without providing either or both of the above-described elastic film 51 and insulator film 52.

In addition, the protection substrate 30 which has a size substantially the same as that of the flow path forming substrate 10 is bonded to the surface on the piezoelectric actuator 300 of the flow path forming substrate 10. The protection substrate 30 has a holding portion 31 which is a space for protecting the piezoelectric actuator 300. In addition, a through hole 32 penetrating in the thickness direction (stacking direction between the flow path forming substrate 10 and the protection substrate 30) is formed in the protection substrate 30. One end portion on a side opposite to the other end portion of the second electrode 80 of a lead electrode 90 is extended so as to be exposed in the through hole 32. The lead electrode 90 and a wiring substrate 102, on which a driving circuit 101 such as a driving IC is mounted, are electrically connected to each other in the through hole 32.

In addition, a case member 40 in which the manifold 100 that communicates with a plurality of pressure generating chambers 12 is demarcated together with the head main body 11 is fixed to the head main body 11 having the above-described configuration. The case member 40 has a shape substantially the same as that of the above-described communication plate 15 in plan view. Moreover, the case member is bonded to the protection substrate 30 and also to the above-described communication plate 15. Specifically, the case member 40 has a recess 41 with a depth for accommodating the flow path forming substrate 10 and the protection substrate 30 on the protection substrate 30 side. The recess 41 has an opening area which is wider than the surface of the protection substrate 30 which is bonded to the flow path forming substrate 10. The surface of the opening on the nozzle plate 20 side of the recess 41 is sealed by the communication plate 15 in a state where the flow path forming substrate 10 or the like is accommodated in the recess 41. Accordingly, a third manifold portion 42 is demarcated on the outer circumferential portion of the flow path forming substrate 10 by the case member 40 and the head main body 11. The manifold 100 of the present embodiment is formed by the first manifold portion 17 and the second manifold portion 18, which are provided on the communication plate 15, and the third manifold portion 42 which is demarcated by the case member 40 and the head main body 11.

As the material of the case member 40, for example, resin, metal, or the like can be used. Incidentally, it is possible to mass-produce the case member 40 at low cost by molding a resin material as the case member.

In addition, the compliance substrate 45 is provided on the surface to which the first manifold portion 17 and the second manifold portion 18 of the communication plate 15 open. The compliance substrate 45 seals the opening of the first manifold portion 17 and the second manifold portion 18 on the liquid ejecting surface 20*a* side.

Such a compliance substrate 45 is provided with a sealing film 46 and a fixing substrate 47 in the present embodiment. The sealing film 46 is constituted of a flexible thin film (for example, a thin film which has a thickness of less than or equal to 20 μm and is formed of polyphenylene sulfide (PPS), stainless steel (SUS), or the like), and the fixing substrate 47 is formed of a hard material, for example metal such as stainless steel (SUS). A region of the fixing substrate 47 facing the manifold 100 is set to an opening 48 which is completely removed in the thickness direction, and therefore, one surface of the manifold 100 is set to a compliance portion as a flexible portion which is sealed only by the flexible sealing film 46.

An introduction path 44 which communicates with the manifold 100 and is used for supplying an ink to each manifold 100 is provided in the case member 40. In addition, a connection port 43 which communicates with the through hole 32 of the protection substrate 30 and into which the wiring substrate 121 is inserted is provided in the case member 40.

In the ink jet recording head II with such a configuration, when ejecting an ink, the ink is taken in from an ink cartridge through the introduction path 44 and the inside of the flow path is filled with the ink until the ink reaches the nozzle opening 21 from the manifold 100. Then, the vibrating plate 50 is warped and deformed together with the piezoelectric actuator 300 by applying a voltage to each piezoelectric actuator 300 corresponding to the pressure generating chamber 12 in accordance with a signal from the driving circuit 101. Accordingly, the pressure in the pressure generating chamber 12 increases and ink droplets are ejected from the nozzle opening 21. In the ink jet recording head II of the present embodiment, the path from the connection port 43 to the nozzle opening 21 is referred to as a liquid flow path. That is, the liquid flow path is formed by the connection port 43, the manifold 100, the supply communication path 19, the pressure generating chamber 12, the nozzle communication path 16, and the nozzle opening 21.

In addition, a cover head 105 which is a protection member of the present embodiment is provided on the liquid ejecting surface 20*a* side of the head main body 11. The cover head 105 is bonded to the compliance substrate 45 on a surface side opposite to the communication plate 15, and seals a space on a side opposite to the flow path (manifold 100) of a compliance portion 49. An exposure opening 106 in which the nozzle opening 21 is exposed is provided in the cover head 105. In the present embodiment, the exposure opening 106 has an opening with a size sufficient for exposing the nozzle plate 20, that is, an opening which is the same size as that of the compliance substrate 45.

In addition, in the present embodiment, the cover head 105 is provided such that the end portion of the cover head is curved from the liquid ejecting surface 20*a* side so as to cover the side surface (surface intersecting with the liquid ejecting surface 20*a*) of the head main body 11.

In the present embodiment, such a cover head 105 is provided protrusively further on the recording sheet S than the liquid ejecting surface 20*a* of the nozzle plate 20 in a discharging direction of an ink (liquid). It is difficult for the recording sheet S to come into contact with the nozzle plate 20 by making the cover head 105 protrude further on the recording sheet S side than the liquid ejecting surface 20*a*. Therefore, it is possible to suppress deformation of the nozzle plate 20 and generation of peeling or the like due to contact between the recording sheet S and the nozzle plate 20.

In addition, a liquid repellent film which has a liquid repellent property may be provided on a surface on a side the same as the liquid ejecting surface 20*a* of such a cover head 105, that is, a surface on a side opposite to the compliance substrate 45, similarly to the nozzle plate 20.

Here, the region which is capped by the suction cap 8 or the protection cap 9 is a portion that includes the entire nozzle plate 20 and a region corresponding to at least a part of the manifold 100, on a plane along the liquid ejecting surface 20*a*, that is, a portion that includes a region in which the end portion of the suction cap 8 or the protection cap 9 corresponds to a compliance portion as a flexible portion which is sealed by only the flexible sealing film 46 of the compliance substrate 45 that defines the manifold 100.

Such an ink jet recording head II is mounted in the ink jet recording apparatus I such that the second direction Y becomes a main scanning direction which is a movement direction of the carriage 2.

Figure 6:
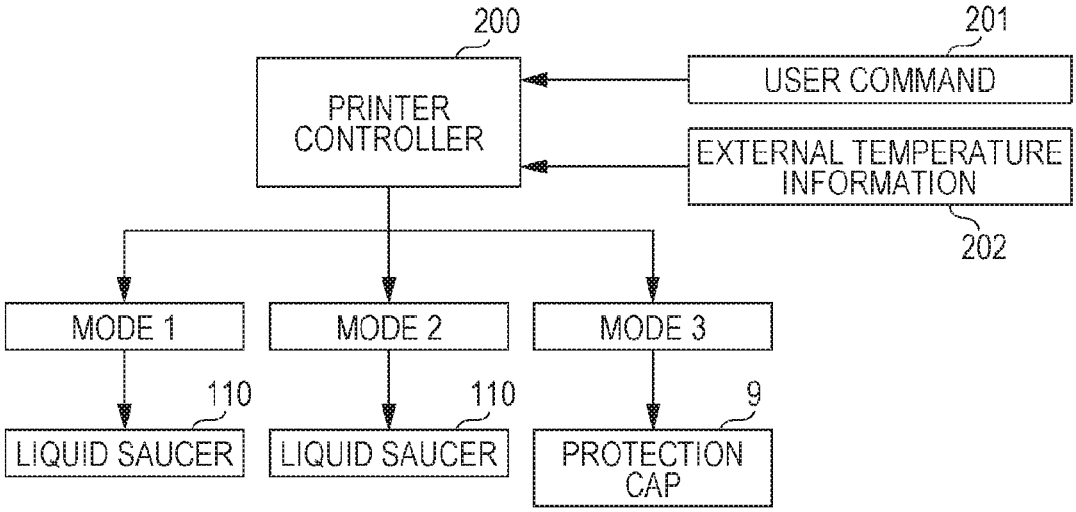
FIG. 6 is a view illustrating each mode of the recording apparatus according to Embodiment 1 of the invention.

FIG. 6 is a view illustrating states in which a printer controller as a control unit carries out Modes 1 to 3. As shown in FIG. 6, a printer controller 200 carries out Modes 1 to 3 during a power-off state or a power saving state.

Here, Mode 1 is executed to prevent cracking (hereinafter, in some cases, expressed as destruction) of a vibrating plate or the like due to an increase in the pressure in the pressure generating chamber 12 due to freezing of a liquid in the pressure generating chamber 12 or the manifold 100, and is carried out when the environmental temperature in use is below the temperature at which a liquid freezes while moving and transporting the product in a case where the product is not in use for a long period of time. In Mode 1, processing of making the manifold 100 communicating with the nozzle openings 21 contain air bubbles is performed. Driving for drawing these air bubbles may be performed before or after regulating the reciprocation using a lock mechanism 910 to be described below.

Here the amount of air bubbles drawn into the manifold 100 is greater than or equal to 10% of a volume of the manifold 100, preferably greater than or equal to 30%, and more preferably greater than or equal to 50%. Accordingly, it is possible to effectively prevent the cracking of the vibrating plate or the like due to an increase in the pressure in the pressure generating chamber 12 due to freezing of a liquid in the pressure generating chamber 12 or the manifold 100.

The selection Mode 1 is carried out based on a user command 201, for example, when a user turns on a switch for selecting Mode 1. Mode 1 may be carried out based on determination of whether to carry out Mode 1 based on acquisition of external temperature information 202 from a detection unit such as a temperature sensor measuring the environmental temperature, which is performed by the printer controller 200, in addition to the user command 201. In either case where the execution of Mode 1 depends on the selection by a user or where the execution of Mode 1 depends on the detection result of the detection unit, it is possible to prevent the vibrating plate or the like from being destroyed, and Mode 1 is executed with high operability.

Specifically, in Mode 1, the nozzle surface of the liquid ejecting head unit 1 faces the liquid saucer 110 in a case where air bubbles are drawn in the manifold 100. However, Mode 1 is a mode in which the apparatus enters a power-off state or a power saving state in a state where the nozzle openings 21 are not capped. A countermeasure against freezing is taken by drawing air bubbles into the manifold 100. In addition, since the liquid saucer 110 is disposed so as to face the nozzle openings 21, it is possible to reduce contamination of a main body of the apparatus caused by a dripping liquid even if the liquid easily drips from the nozzle openings 21 due to expanded air bubbles.

Figure 7A:
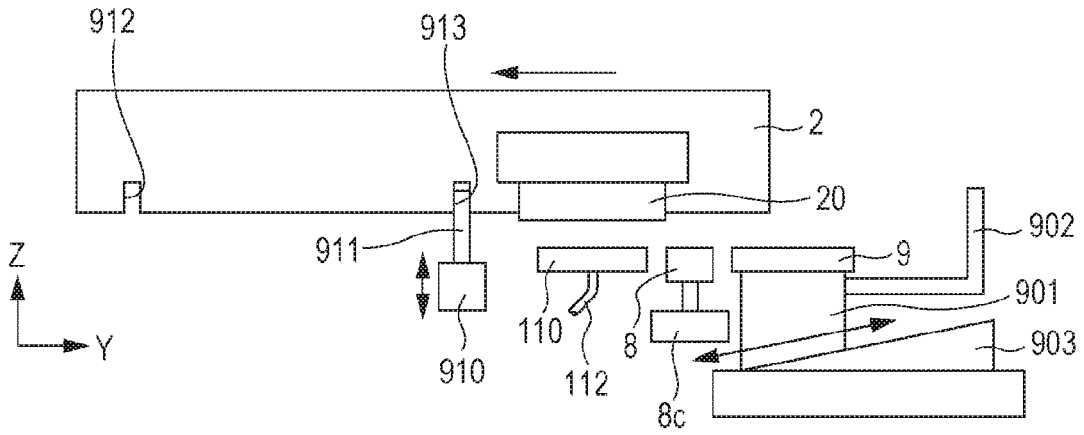
FIGS. 7A and 7B are schematic views illustrating each mode of Embodiment 1.
Figure 7B:
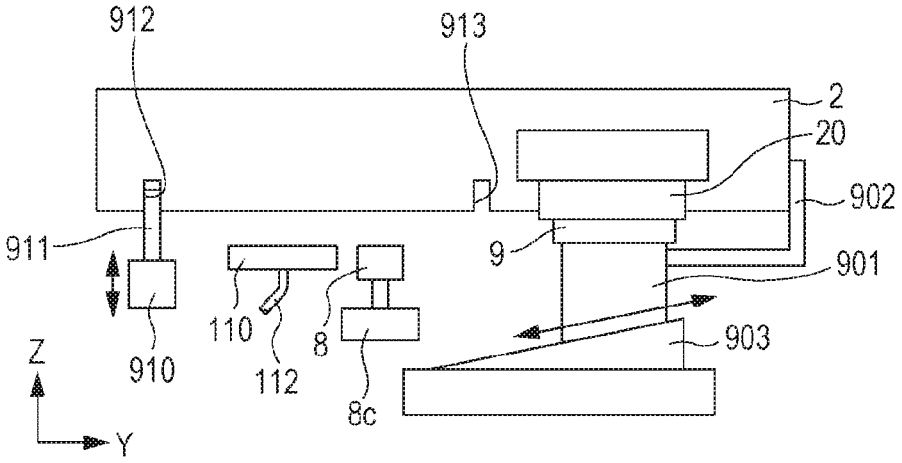

This state is shown in FIGS. 7A and 7B. FIG. 7A shows a state in which the carriage 2 moves to a region facing the liquid saucer 110 due to the power being turned off and the liquid saucer 110 is stopped in a state of not being closely adhered to the nozzle plate 20. This state is set to a stopped state after Mode 1.

In addition, in the state of FIG. 7A, a locking rod 911 of a carriage lock mechanism (also called a lock mechanism) 910, which is a regulating unit that regulates the movement of the carriage 2 in a reciprocation direction, is inserted into a locking hole 913 of the carriage 2 at a first position so as to be fixed thereto. This carriage lock mechanism 910 is usually used during Mode 3 of FIG. 7B. In the present embodiment, a second locking hole 913 is provided in the carriage 2 in order to fix the carriage 2 thereto in the state shown in FIG. 7A, that is, in a state where the protection cap 9 is not closely adhered to the nozzle plate 20, in consideration of transportation after carrying out Mode 1. This position is set to the first position as described above. Accordingly, it is possible to prevent unexpected movement of the carriage 2 during transportation or the like. In this manner, it is possible to regulate the movement in the reciprocation direction at a position corresponding to the two locking holes 912 and 913, using one lock mechanism 910, and therefore, an effect in which it is possible to reduce the number of parts is exhibited. Both the lock mechanism 910 and the carriage 2 may be engaged to be made to enter a locked state by providing a concave portion on the side of the lock mechanism 910 and a convex portion on the side of the carriage 2.

In addition, Mode 2 is a mode, which is selected in a case where it is necessary to perform transportation in a state of not using the protection cap 9, and is the same as Mode 1 except that processing of making air bubbles contained in the manifold 100 communicating with the nozzle openings 21 is not performed. That is, as shown in FIG. 7A, Mode 2 shows a state in which the carriage 2 moves to a region facing the liquid saucer 110 due to the power being turned off and the liquid saucer 110 is stopped in a state of not being closely adhered to the nozzle plate 20. In Mode 2, the movement of the carriage 2 in the reciprocation direction is regulated in a state where the liquid ejecting head unit 1 faces the liquid saucer 110, and therefore, even if the apparatus is moved through transportation or the like, the carriage 2 does not unexpectedly move and the main body of the apparatus is not contaminated due to dripping liquid.

In Mode 2 and the above-described Mode 1, the liquid ejecting head unit 1 is corresponded to the protection cap 9 without providing the liquid saucer 110. However, the carriage 2 may be made to enter a locked state in a state where the protection cap 9 and the liquid ejecting head unit 1 are separated from each other. However, in the present embodiment, the liquid saucer 110 is provided separately from the protection cap 9. Therefore, it is possible to prevent the dripping liquid from blocking of the atmosphere release path of the protection cap 9.

In contrast, Mode 3 is a usual mode, is a case of a state in which there is no concern of freezing or the like, and is a mode which enters a power-off state or a power saving state in a state where the nozzle openings 21 are capped by the protection cap 9.

FIG. 7B shows a state of Mode 3 which enters a state in which the protection cap 9 and the support member 901 move obliquely upward along a tilting table 903 and the protection cap 9 is closely adhered to the nozzle plate 20.

That is, if the carriage 2 moves to a region facing the protection cap 9 in a non-printing region, a locking member 902 which is provided on the support member 901 that supports the protection cap 9 is locked by the carriage 2, and the protection cap 9 and the support member 901 move obliquely upward along the tilting table 903.

In the state of FIG. 7B, the locking rod 911 of the carriage lock mechanism 910 which is a regulating unit that regulates the movement of the carriage 2 is inserted into the locking hole 912 of the carriage 2 so as to be fixed thereto.

Here, turning off of the power includes an off state due to a power saving mode or the like in addition to a state where a main switch is turned off. Here, the power saving mode refers to states where at least any of states is executed in which power supply to a driving circuit provided in the liquid ejecting apparatus is blocked, power supply to a circuit of a detection unit is blocked, the voltage of the power supplied to these circuits is decreased, or display of a panel provided in the liquid ejecting apparatus is turned off. Moreover, the power saving mode is completely distinguished from a standby state such as print waiting, or an operation state.

Such a stopped state of Mode 1 is set in order to cause freezing due to a liquid in the nozzle openings 21 in a case where there is liquid in the nozzle openings 21, by actively exposing the vicinity of the nozzle openings 21 to an environmental temperature.

As described above, the region which is capped by the protection cap 9 is a portion including a region corresponding to the entire nozzle plate 20 and at least a part of the manifold 100, on a plane along the liquid ejecting surface 20*a*. That is, in a capped state using the protection cap 9, the nozzle plate 20 and the lower part of the manifold 100 such as a compliance portion of a compliance substrate 45 are exposed to the same temperature as each other.

Figure 9A:
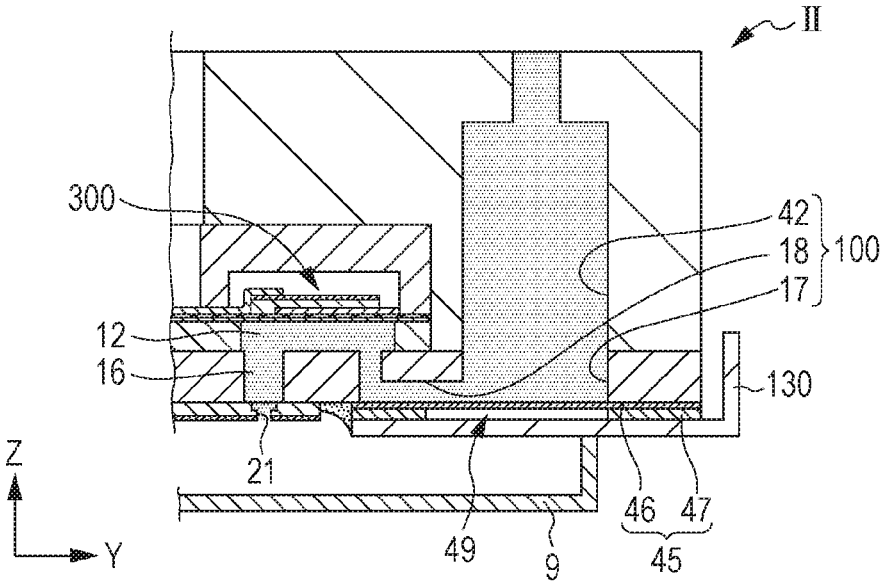
FIGS. 9A and 9B are schematic views illustrating frozen states in a case where Mode 1 is not carried out.
Figure 9B:
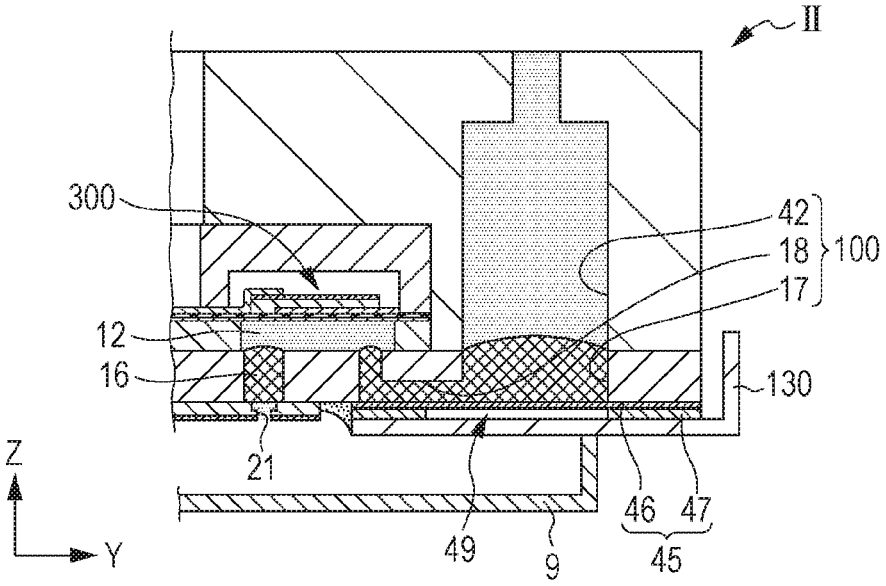

FIGS. 9A and 9B show this state. In FIGS. 9A and 9B, the liquid is represented by a dot pattern and the frozen portion is represented by cross-hatching.

If freezing starts in a state where the portion from a nozzle opening 21 to the manifold 100 is filled with a liquid as shown in FIG. 9A, freezing of a liquid in the nozzle opening 21 and freezing of a liquid in the lower portion in the manifold 100 start substantially at the same time as each other. If the freezing proceeds as shown in FIG. 9B, a flow path on a side communicating with the nozzle opening 21 of a pressure generating chamber 12 and a flow path on a side communicating with the manifold 100 freeze. When a liquid in the pressure generating chamber 12 freezes, the apparatus enters a state where there is no place for the expansion pressure to escape, which causes destruction of a vibrating plate or the like.

However, if the apparatus enters a power-off state or a power saving state by carrying out Mode 1 as described above, the nozzle opening 21 enters a state of not being capped by the protection cap 9, and a liquid in the nozzle opening 21 which has a small amount of liquid freezes first. In contrast, the lower portion of the manifold 100 is set to the compliance portion 49 of the compliance substrate 45. The compliance portion 49 has a thermal insulation structure formed of a stacked structure of SUS and the flexible sealing film 46, and also interposes an air layer. Therefore, the compliance portion has a thermal conductivity which is lower than that of the nozzle plate 20 and has a large amount of a liquid therein, and thus, the freezing is delayed. Accordingly, even in a case where freezing in a pressure generating chamber 12 is caused after the progression of the freezing of a liquid from the nozzle opening 21 side, the flow path on a side communicating with the manifold 100 is in a state of not freezing, and the increase in the pressure due to the freezing of a liquid in the pressure generating chamber 12 is absorbed on the manifold 100 side, and therefore, the destruction of a vibrating plate or the like is prevented. That is, in the present embodiment, the compliance portion 49 is a thermal insulation member, has a thermal conductivity lower than that of the nozzle plate 20, and has a multilayer structure including SUS, the flexible sealing film 46, and an air layer. Accordingly, the freezing of the liquid in the manifold is more delayed than that of the liquid in the nozzle opening 21, and therefore, cracking in the pressure generating chamber 12 can be more reliably prevented.

Figure 8A:
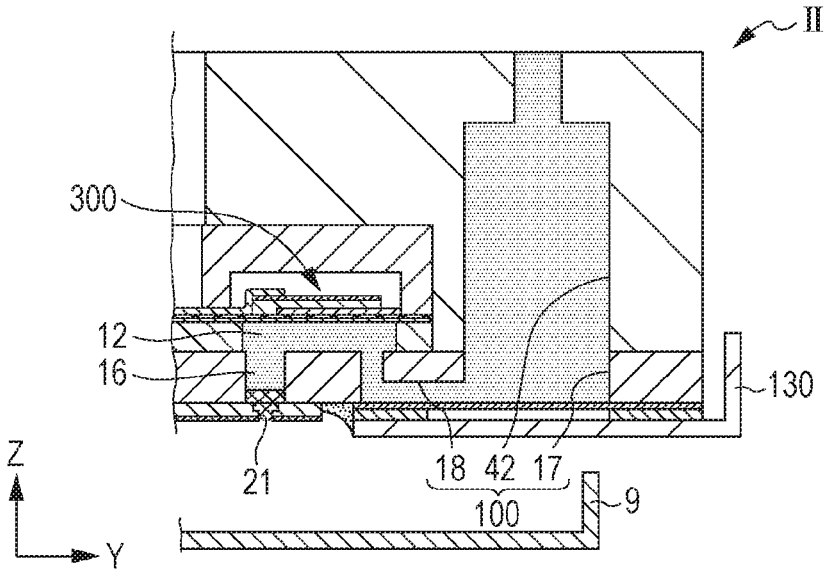
FIGS. 8A and 8B are schematic views illustrating frozen states after carrying out Mode 1.
Figure 8B:
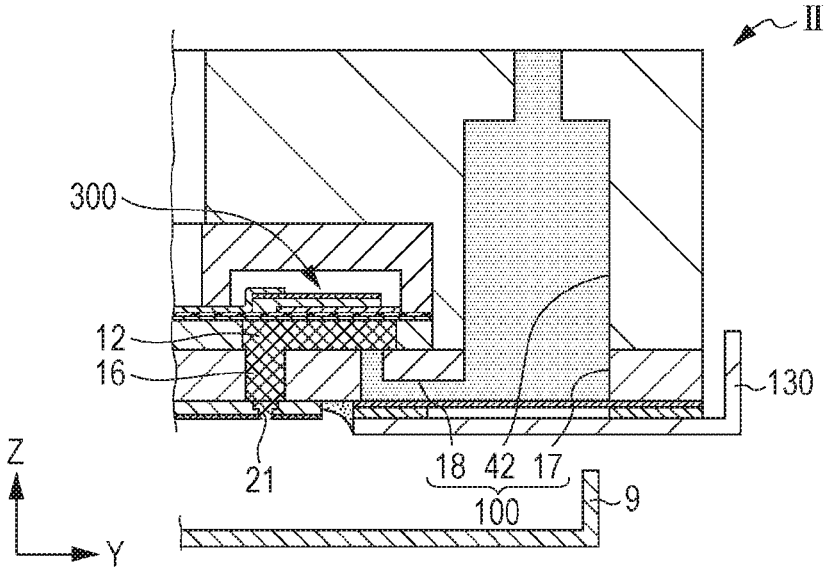

This state is shown in FIGS. 8A and 8B. In FIGS. 8A and 8B, the liquid is represented by a dot pattern and the frozen portion is represented by cross-hatching.

When the nozzle opening 21 enters a state of not being capped by the protection cap 9 through Mode 1, a liquid in the nozzle opening 21 which is a small amount of liquid freezes first and the freezing proceeds as shown in FIG. 8A. Even if the inside of the pressure generating chamber 12 freezes as shown in FIG. 8B, the liquid in the manifold 100 does not hardly freezes, and therefore, destruction due to an increase in the pressure in the pressure generating chamber 12 is prevented.

Embodiment 2

The evacuation operation which is performed in the liquid saucer 110 provided in addition to the suction cap 8 and the protection cap 9, and the reception of a liquid in Mode 1 and Mode 2 are made to be performed in the above-described embodiment. However, the liquid saucer 110 may not have a dimension in which the liquid saucer 110 faces all of the nozzle surfaces of the plurality of heads of the liquid ejecting head unit 1.

Figure 10A:
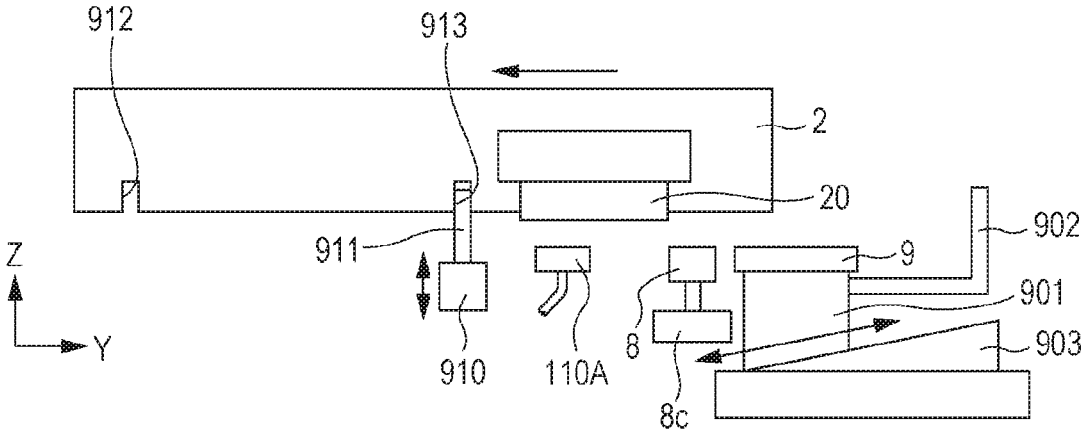
FIGS. 10A and 10B are views illustrating states of Modes 1 and 2 according to another embodiment.

In FIG. 10A, a liquid saucer 110A having a dimension smaller than that facing all of the nozzle surfaces of the plurality of heads of the liquid ejecting head unit 1 is provided. In this case, in Mode 1 and Mode 2, the liquid saucer is made to face nozzle surfaces of heads, from which it is relatively easy for a liquid to drip, and is made not to face heads from which it is relatively difficult for a liquid to drip, among a plurality of heads of the liquid ejecting head unit 1. Accordingly, it is possible to achieve miniaturization of the liquid saucer, thereby realizing space-saving. In the evacuation operation, the plurality of heads may be performed in order while moving the liquid ejecting head unit 1.

The heads from which a liquid easily drip are heads in which the viscosity of the liquid is relatively low, heads in which the surface tension of the liquid is small, or heads in which the nozzle diameter is relatively large. In addition, in Mode 1 as a countermeasure against freezing, heads in which many air bubbles are put into the manifold 100 may be selected. In this case, a plurality of locking holes corresponding to heads may be provided.

Embodiment 3

Figure 10B:
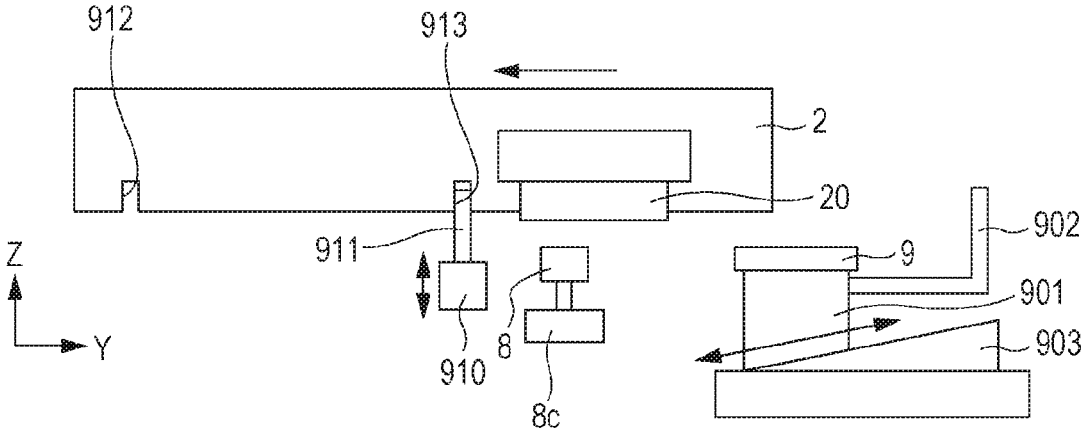

The evacuation operation which is performed by providing the liquid saucer 110 provided in addition to the suction cap 8 and the protection cap 9, and the reception of a liquid in Mode 1 and Mode 2, are made to be performed in the above-described embodiment. However, the reception of a liquid in Mode 1 and Mode 2 may be performed in the suction cap 8 without providing the liquid saucer 110. A configuration in this case is shown in FIG. 10B. Accordingly, it is possible to exclude a member and to realize cost reduction.

The suction cap 8 may not have a dimension in which the liquid saucer 110 faces all of the nozzle surfaces of the plurality of heads of the liquid ejecting head unit 1. Therefore, heads to be faced may be selected in the same manner as in Embodiment 2. In addition, the size of the suction cap 8 may be made large such that the suction cap 8 can face all of the heads.

Other points are the same as those in Embodiment 1 excluding the above-described points, and therefore, the description thereof will not be repeated.

In Modes 1 and 2, the power-off state or the power saving state may be basically set as a premise also in the present embodiment. However, it is unnecessary to set the power-off state or the power saving state as a premise. In either case where the execution of Mode 1 depends on the selection by a user or where the execution of Mode 1 depends on the detection result of the detection unit, it is possible to lock the carriage using the carriage lock mechanism 910 in a case where the liquid saucer 110 is made to face the nozzle openings 21, through the execution of Mode 1. In addition, the carriage lock is performed using the carriage lock mechanism 910 in a state where the nozzle openings 21 are capped by the protection cap 9, through the execution of Mode 3. Accordingly, it is possible to progress the freezing in the nozzle openings 21 or the pressure generating chambers 12 prior to the freezing in the manifold 100 through the execution of Mode 1 even if the apparatus is not in a power-off state or a power saving state, and therefore, it is possible to prevent cracking in the pressure generating chamber. In addition, the carriage lock is performed using the carriage lock mechanism 910, and therefore, relative movement during movement, transportation, or the like is prevented.

Other Embodiments

Embodiments of the invention have been described above, but the basic configuration of the invention is not limited to the above-described description.

In the above-described embodiments, the recording head having a configuration in which the communication plate 15 is provided between the flow path forming substrate 10 and the nozzle plate 20 has been exemplified, but the recording head may have a configuration in which the communication plate 15 is not provided.

Figure 11:
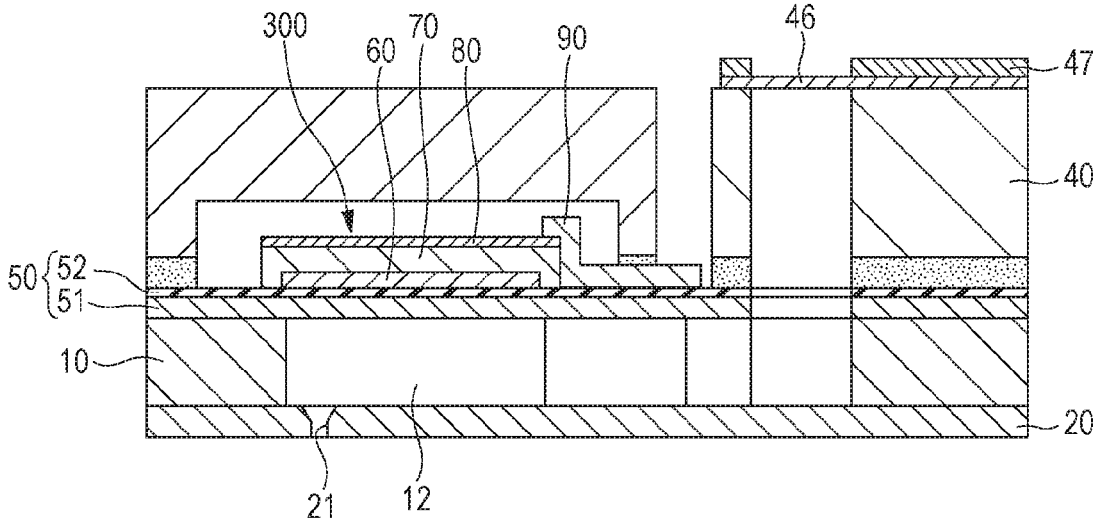
FIG. 11 is a cross-sectional view showing an example of a recording head according to another embodiment.

A configuration in which a nozzle plate 20 is directly bonded to the flow path forming substrate 10 without being provided with a communicating plate is exemplified in FIG. 11. The same members as in the above-described embodiments are given the same reference numerals and the description thereof will not be repeated.

In addition, in the above-described ink jet recording apparatus I of Embodiments 1 to 3, examples in which the ink jet recording head II (head unit 1) is mounted on the carriage 2 and moves in the main scanning direction have been exemplified, but the invention is not particularly limited thereto. For example, it is also possible to apply the invention to a so-called line type recording apparatus in which the ink jet recording head II is fixed and printing is performed by simply moving a recording sheet S such as paper in the sub-scanning direction. That is the reciprocation of the ink jet recording head II (head unit 1) is not limited to the movement in the main scanning direction, and may be movement in other directions.

In addition, the above-described example of the ink jet recording apparatus I is an example in which a liquid storage unit such as an ink tank is fixed to the main body of the apparatus and the liquid storage unit and the ink jet recording head II are connected to each other through a supply tube such as a tube. However, the invention is not particularly limited thereto, and the liquid storage unit may not be mounted in the ink jet recording apparatus. In addition, the apparatus may have a configuration in which an ink cartridge which is a liquid storage unit is mounted on the carriage 2.

Furthermore, in the above-described Embodiments 1 to 3, the thin film type piezoelectric actuator 300 has been described as a pressure generating unit which causes a pressure change in the pressure generating chamber 12, but the invention is not particularly limited thereto. For example, it is possible to use a thick film type piezoelectric actuator, which is formed through a method such as pasting green sheets on each other, a vertical vibration type piezoelectric actuator, which is obtained by alternately stacking a piezoelectric material and an electrode forming material and extending the materials in the axial direction. In addition, it is possible to use an actuator in which a heating element is disposed in a pressure generating chamber as a pressure generating unit and liquid droplets are discharged through a nozzle opening due to bubbles which are generated by heat generation of the heating element, or a so-called electrostatic actuator in which static electricity is generated between a vibrating plate and an electrode, and liquid droplets are discharged through a nozzle opening using the vibrating plate deformed by the electrostatic force.

In addition, in the above-described embodiments, the ink jet recording apparatus which has the ink jet recording head has been described as an example of the liquid ejecting apparatus. However, in the invention, the entire liquid ejecting apparatus is widely set as a target, and as a matter of course, the invention can also be applied to a liquid ejecting apparatus which includes a liquid ejecting head that ejects a liquid other than an ink. Examples of other liquid ejecting heads include various recording heads which are used in an image recording apparatus such as a printer; a color material ejecting head which is used for manufacturing a color filter of a liquid crystal display or the like; an organic EL display; an electrode material ejecting head which is used for forming an electrode of a field emission display (FED) or the like; and a bio-organic ejecting head which is used for manufacturing a biochip. The invention can also be applied to a liquid ejecting apparatus provided with such liquid ejecting heads.

What is claimed is:

1. A liquid ejecting apparatus comprising:

a head configured to reciprocate and having a nozzle surface provided with a nozzle for discharging a liquid;

a lock configured to regulate reciprocation of the head; and a liquid saucer configured to receive the liquid, wherein the nozzle surface of the head faces the liquid saucer and is separated from the liquid saucer in a state where reciprocation is regulated by the lock.

2. The liquid ejecting apparatus according to claim 1, wherein the lock regulates reciprocation of the head at each of a first position and a second position of the head, wherein the head faces the liquid saucer and is separated from the liquid saucer in a state where reciprocation is regulated at the first position by the lock, and wherein the head faces a cap and comes into contact with the liquid saucer in a state where reciprocation is regulated at the second position by the lock.

3. The liquid ejecting apparatus according to claim 2, wherein the liquid saucer has a discharge port which is connected to a discharge path on a surface facing the nozzle surface, wherein the cap has a rib and an atmosphere release path, wherein the rib forms a closed space between the nozzle surface and the rib by being closely adhered to the nozzle surface, and wherein the atmosphere release path allows communication between the closed space and the atmosphere.

4. The liquid ejecting apparatus according to claim 2, wherein the liquid saucer is connected to a pump for suctioning the liquid from the nozzle.

5. The liquid ejecting apparatus according to claim 1, wherein the liquid saucer has a discharge port which is connected to a discharge path on a surface facing the nozzle surface, wherein the cap has a rib and an atmosphere release path, wherein the rib forms a closed space between the nozzle surface and the rib by being closely adhered to the nozzle surface, and wherein the atmosphere release path allows communication between the closed space and the atmosphere.

6. The liquid ejecting apparatus according to claim 5, wherein the cap is lifted through reciprocation of the head, and wherein the liquid saucer is not lifted through the reciprocation of the head.

7. The liquid ejecting apparatus according to claim 6, wherein the liquid saucer receives a liquid discharged from the head during evacuation.

8. The liquid ejecting apparatus according to claim 6, wherein the liquid saucer has a dimension in which the liquid saucer faces a nozzle of a liquid which is most easily dripped and does not face a nozzle of a liquid which is most hardly dripped, among a plurality of liquids.

9. The liquid ejecting apparatus according to claim 6, wherein the head in a state where reciprocation is regulated by the lock at the second position contains air bubbles in a manifold which communicates with the nozzle.

10. The liquid ejecting apparatus according to claim 5, wherein the liquid saucer receives a liquid discharged from the head during evacuation.

11. The liquid ejecting apparatus according to claim 10, wherein the liquid saucer has a dimension in which the liquid saucer faces a nozzle of a liquid which is most easily dripped and does not face a nozzle of a liquid which is most hardly dripped, among a plurality of liquids.

12. The liquid ejecting apparatus according to claim 10, wherein the head in a state where reciprocation is regulated by the lock at the second position contains air bubbles in a manifold which communicates with the nozzle.

13. The liquid ejecting apparatus according to claim 5, wherein the liquid saucer has a dimension in which the liquid saucer faces a nozzle of a liquid which is most easily dripped and does not face a nozzle of a liquid which is most hardly dripped, among a plurality of liquids.

14. The liquid ejecting apparatus according to claim 13, wherein the head in a state where reciprocation is regulated by the lock at the second position contains air bubbles in a manifold which communicates with the nozzle.

15. The liquid ejecting apparatus according to claim 5, wherein the lock is either of a concave portion and a convex portion which are engaged with each other, and wherein the head or a carriage has a plurality of the other sides of the concave portions and the convex portions.

16. The liquid ejecting apparatus according to claim 5, wherein the head in a state where reciprocation is regulated by the lock at the second position contains air bubbles in a manifold which communicates with the nozzle.

17. The liquid ejecting apparatus according to claim 1, wherein the liquid saucer is connected to a pump for suctioning the liquid from the nozzle.

18. The liquid ejecting apparatus according to claim 17, wherein the liquid saucer receives a liquid discharged from the head during evacuation.

19. The liquid ejecting apparatus according to claim 17, wherein the liquid saucer has a dimension in which the liquid saucer faces a nozzle of a liquid which is most easily dripped and does not face a nozzle of a liquid which is most hardly dripped, among a plurality of liquids.

20. The liquid ejecting apparatus according to claim 17, wherein the head in a state where reciprocation is regulated by the lock at the second position contains air bubbles in a manifold which communicates with the nozzle.

* * * * *